United States Patent [19]

Meyers et al.

[11] 4,148,435

[45] Apr. 10, 1979

[54] INDUCTION AIR MIXING BOX CONTROL

[75] Inventors: Frederick J. Meyers, Harlem Township, Winnebago County, Ill.; Marvin H. Zille, Beloit, Wis.

[73] Assignee: Barber-Colman Company, Rockford, Ill.

[21] Appl. No.: 810,235

[22] Filed: Jun. 27, 1977

[51] Int. Cl.[2] ..... F24F 13/04

[52] U.S. Cl. ..... 236/13; 236/49

[58] Field of Search ..... 236/13, 49

[56] References Cited

U.S. PATENT DOCUMENTS

| | | | |
|---|---|---|---|
| 3,516,606 | 6/1970 | Edwards | 236/13 |
| 3,604,625 | 9/1971 | Waeldner | 236/13 |
| 3,809,314 | 5/1974 | Engelke et al. | 236/49 |
| 3,883,071 | 5/1975 | Meckler | 236/13 X |
| 3,934,795 | 1/1976 | Ginn et al. | 236/13 |
| 3,945,565 | 3/1976 | Lynch et al. | 236/49 |
| 3,989,187 | 11/1976 | Osheroff | 236/13 |
| 3,994,434 | 11/1976 | Boyer et al. | 236/49 |
| 4,042,173 | 8/1977 | Boyer et al. | 236/49 |

*Primary Examiner*—Robert Mackey

*Attorney, Agent, or Firm*—A. Richard Koch

[57] ABSTRACT

A control for an induction air mixing box for mixing conditioned primary air and induced secondary air for delivery at a substantially constant volume rate of flow into a condition controlled space, the volume rate of flow of primary air being maintained constant at a predetermined rate, said predetermined rate being resettable as a function of the sensed condition in the space. The induced rate of flow of secondary air is restricted as another function of the sensed condition, the change in rate of flow of the secondary air being inverse to that of the primary air.

10 Claims, 3 Drawing Figures

PRESSURIZED CONDITIONED PRIMARY AIR

FLOW SENSING
SECONDARY AIR
FLOW CONTROLLING
FLOW RESTRICTING
RECEIVING
FLOW INDUCING
INDUCTION AIR MIXING BOX
MIXING
DELIVERING
CONDITION SENSING

INDUCTION AIR MIXING BOX CONTROL

BACKGROUND OF THE INVENTION

In air conditioning a space for temperature, especially when cooling is required, it is desirable to deliver air at a temperature that is not uncomfortable to occupants of the space who happen to be in the path of the delivered air. On the other hand, it is desirable to provide air to an extreme temperature in order to limit the size of supply ducts and other equipment. Induction mixing boxes have been employed to accomplish both of these desirable results. Primary air at a relatively low constant temperature is carried through small ducts to an induction mixing box, in which flow of the primary air is employed to induce flow of secondary air thereinto. The secondary air is usually return air from the space, so that its temperature is probably at approximately the sensed space temperature. By properly proportioning the flows of primary and secondary air into the mixing box, the resulting mixed air has a temperature below the desired space temperature, but it is not uncomfortable to those occupants of the space who are in its path. Since it is the primary air that provides the required cooling, it is the volume rate of flow of primary air that must be controlled in order to maintain the conditioned space at substantially the desired set point temperature. By controlling the volume rate of flow of secondary air inversely as the primary rate, the volume rate of flow of mixed air into the controlled space is maintained substantially constant, so that air circulation in the space remains substantially unchanged regardless of the cooling requirements. U.S. Pat. Nos. such as Kennedy 3,114,505, issued on Dec. 17, 1963; Schach Re. 26,690 of 3,361,157, issued on Jan. 2, 1968; and Zille and Engelke 3,583,477, issued on June 8, 1971 are representative of the development of such induction mixing boxes. In each of these patents, one damper is employed to maintain a constant static air pressure upstream from a primary flow control damper, which then provides a desired volume rate of flow of primary air thereby controlling the amount of cooling supplied, while a secondary air damper determines the volume rate of flow of secondary air in order to maintain a substantially constant flow of mixed air into the controlled space.

A U.S. Pat. No. 3,809,314, issued on May 7, 1974 to Engelke and Zille, discloses a resettable constant volume air damper control.

SUMMARY OF THE INVENTION

According to the present invention, the volume rate of flow of primary air is maintained substantially constant at a predetermined value, which is reset as a function of the magnitude of a sensed controlled condition in a condition controlled space. The volume rate of flow of secondary air is then limited to provide maximum cooling, when that is desirable, or as an inverse function of the magnitude of the controlled condition to maintain the volume rate of flow of mixed air into the condition controlled space at a substantially constant value.

DESCRIPTION OF THE PREFERRED METHOD

Figure 1:
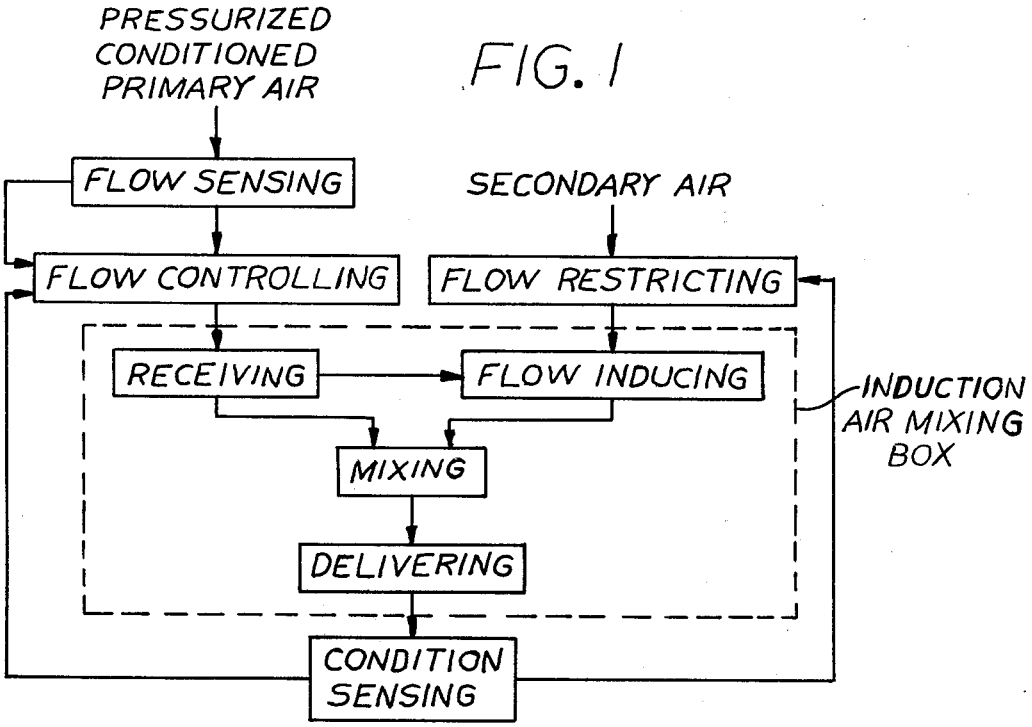
FIG. 1 is a flow chart illustrative of the method employed according to this invention.

As shown in FIG. 1 pressurized conditioned primary air is received in an induction air mixing box, where the flow of the primary air induces a flow of secondary air into the box, the flows of primary and secondary air are mixed and delivered to a condition controlled space according to the prior art. This invention improves upon the prior art by sensing the magnitude of the volume rate of flow of said primary air received in the box and controlling such flow in response to the sensed flow at a substantially constant predetermined rate, sensing the magnitude of the controlled condition in said space, resetting the predetermined rate of flow as a function of the sensed magnitude of the controlled condition in the space and restricting the flow of said secondary air into the box as another function of the sensed magnitude of the controlled condition.

Let us assume that the primary air is cooled and that the secondary air is return air from a temperature controlled room. The flow sensor exerts control over the flow controlling means to maintain a substantially constant volume rate of flow of primary air into the mixing box. This regulated flow of primary air will induce a certain substantially constant volume rate of flow of secondary air into the mixing box. The secondary air, being at a higher room temperature than the primary air, mixes with the primary air to provide mixed air at an intermediate temperature, which mixed air is delivered to the condition controlled space. Since the intermediate temperature of the mixed air is below room temperature, the mixed air reduces the room temperature. If the room is initially hot, maximum cooling is required to bring the room temperature down to a desired set point as rapidly as possible. To this end the volume rate of flow of primary air is maintained substantially constant at a predetermined maximum, while the volume rate of flow of secondary air is prevented or restricted to a low rate. As the sensed room air temperature falls below a predetermined value, the volume rate of flow of primary air is reduced as a direct function of the sensed temperature. At the same time the volume rate of flow of secondary air is increased as an inverse function of the sensed temperature in order to maintain a substantially constant volume rate of flow of mixed air into the room. This continues until the volume rate of flow of primary air is just sufficient to supply the heat losses from the room at the set point temperature. If the room air temperature falls below the set point, the volume rate of flow of primary air is further reduced as a function of the sensed temperature, thus reducing the cooling supplied to less than that required to replace the heat loss and thereby increasing the room air temperature. In general, the volume rate of flow of conditioned primary air is modulated as a function of the sensed magnitude of a controlled condition in a condition controlled space to produce and maintain a predetermined condition in the space, while the volume rate of flow of secondary air, at a different condition, is modulated to maintain a substantially constant volume rate of flow of mixed air into said space in order to provide sufficient air circulation in the space to provide a substantially uniform condition therein. Since secondary air flow is induced by flow of primary air, primary air flow of at least a predetermined rate is maintained at all times to assure air circulation in the controlled space.

DESCRIPTION OF THE PREFERRED EMBODIMENT

Figure 2:
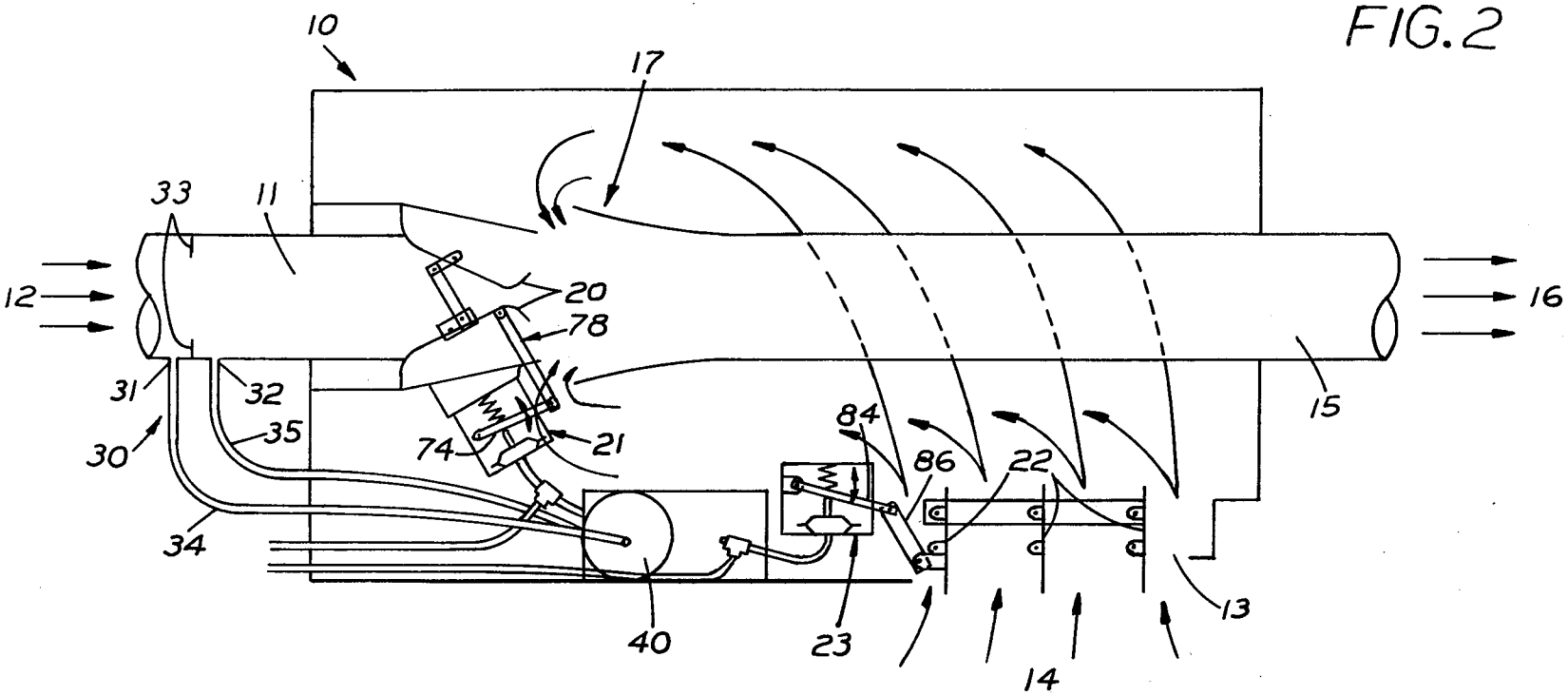
FIG. 2 is a section view of a mixing box employing the method and apparatus according to this invention.

As shown in FIG. 2, an induction mixing box 10 has an inlet 11 for entrance into the box of conditioned primary air 12 delivered, at above atmospheric pressure, from a primary source (not shown), an inlet 13 for entrance of secondary (usually return) air 14 into the box, an outlet 15 for exhaust of mixed primary and secondary air 16 from the box for delivery to a condition controlled space (not shown), and means 17 in the box for inducing flow of secondary air into the box in response to flow of primary air therethrough, the primary and secondary air being mixed as a result of the induction. A primary damper 20, positioned by an actuator 21, controls the volume rate of flow of primary air 12 through inlet 11. a second damper 22, positioned by an actuator 23, restricts the flow of secondary air 14 through inlet 13. The apparatus so far described is well-known in the art.

The present invention concerns apparatus for controlling operation of the actuators 21, 23 to proportion the primary and secondary air 12, 14 in the mixed air 16 to be delivered to the condition controlled space. As shown in FIG. 2, a flow sensor 30 comprises pressure taps 31, 32 located upstream and downstream, respectively, from a restriction 33 in the path of primary air 12 flowing through inlet 11. Tubes 34, 35 are connected to transmit air pressure from the taps 31, 32, respectively.

Figure 3:
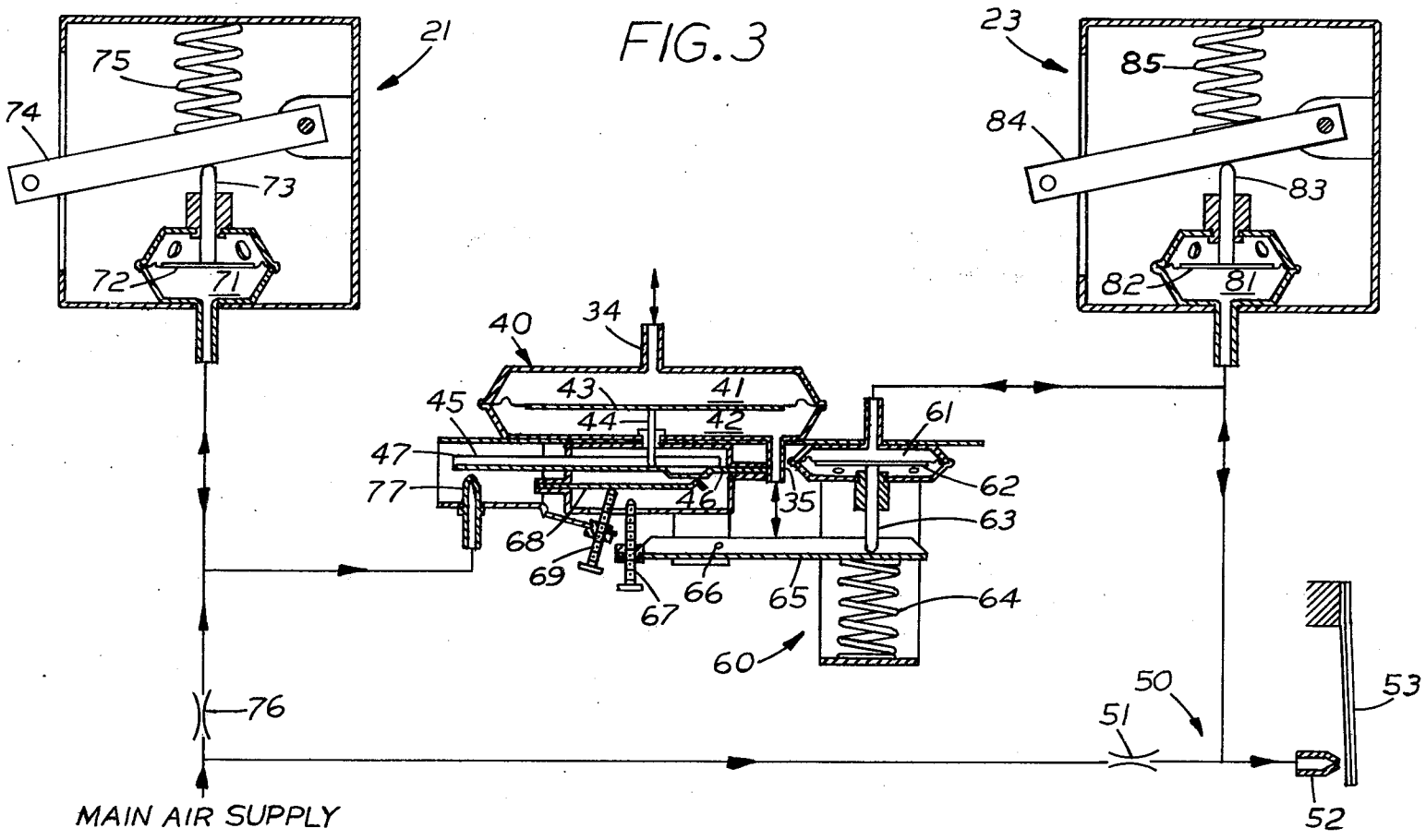
FIG. 3 is a schematic diagram, partially in section, representative of the preferred embodiment of this invention.

A flow transducer 40, as shown in FIG. 3, comprises a high pressure chamber 41 and a low pressure chamber 42 with a flexible diaphragm 43 forming a common wall between the chambers. A rod 44 transmits motion of the diaphragm to the outside of the flow transducer. The upstream tap 31 communicates its pressure output to the high pressure chamber 41 through tube 34 and downstream tap 32 communicates its pressure output to the low pressure chamber 42 through tube 35, so that the flow transducer will be recognized as a differential pressure transducer and the motion of rod 44 will become a flow signal. The rod 44 engages a rigid flapper 45 pivoted at end 46 and having a free end 47.

Pressure regulated air from a main air supply passes into a condition transducer 50 through restrictor 51 to become a condition responsive branch air pressure controlled by bleed of air through a nozzle 52 as permitted by a condition sensor 53. The condition sensor is responsive to a condition being controlled in the condition controlled space. As shown in FIG. 3, it comprises a cantilevered laminated flapper, such as a thermostatic bimetal, movable toward and away from the nozzle 52 in response to the magnitude of the sensed condition. The condition responsive branch air pressure produced in condition transducer 50 thus becomes a condition signal. An operator 60 receives the condition signal as branch air pressure in a pressure chamber 61 having a flexible diaphragm 62 as one wall. The force produced on the diaphragm by the air pressure is transmitted by a guided pin 63 in opposition to the force exerted by a bias spring 64 to one end of a lever 65 rotatable about a pivot 66. At the other end of the lever is an adjustable contact 67, engageable with a cantilevered resilient bias beam 68 to apply a condition variable bias to flapper 45 in opposition to the flow signal. A minimum bias adjustment 69 provides a predetermined minimum bias to flapper 45 through beam 68. The minimum bias along with the flow signal determines the position of the end 47 of flapper 45 in absence of a condition signal. When the condition variable bias exceeds the minimum bias, the position of end 47 is reset as a function of the sensed condition.

The actuator 21 comprises a pressure chamber 71 having a flexible diaphragm 72 as one wall thereof. A guided rod 73 movable by the diaphragm 72 engages an actuating lever 74. A bias spring 75 opposes outward movement of the rod. Chamber 71 receives air from a pressure regulated main air supply through a restrictor 76 and variably exhausts air through a nozzle 77 in response to the position of the free end 47 of flapper 45. As the end 47 moves toward nozzle 77, the pressure in chamber 71 increases and the resulting force exerted on diaphragm 72 is transmitted through rod 73 and against the opposition of spring 75 to move actuating lever 74 upward. The lever 74 is operatively connected to damper 20 by means of a linkage 78, as seen in FIG. 2, so that upward movement of lever 74 moves damper 20 toward closed position. As the pressure in chamber 71 decreases, the spring 75 moves actuating level 74 downward to further open the damper 20.

Actuator 23 comprises a pressure chamber 81 having a flexible diaphragm 82 as one wall thereof. A guided rod 83 movable by the diaphragm 82 engages an actuating lever 84. A bias spring 85 opposes outward movement of the rod. Chamber 81 receives the condition signal as branch air pressure from the condition transducer 50. As the pressure in chamber 81 increases, the resulting force exerted on diaphragm 72 is transmitted through rod 83 against the opposition of spring 85 to move actuating lever 84 upward. The lever 84 is operatively connected to damper 22 by means of a linkage 86, as seen in FIG. 2, so that upward movement of lever 84 moves damper 22 toward closed position. As the pressure in chamber 81 decreases, the spring 85 moves actuating lever 84 downward to further open the damper 22.

Let us assume that the condition controlled space requires cooling in order to maintain a substantially constant temperature therein. The primary air would be cooled to a substantially constant cool temperature, such as 40° F. Upon start-up, the flapper 45 will be positioned by bias beam 68 such that end 47 is spaced from nozzle 77, permitting branch air to bleed therefrom and so lower the pressure in chamber 71, permitting spring 75 to move actuating lever 74 downwardly to assure that damper 20 is open, thus allowing the pressurized cool primary air 12 to enter the mixing box 10 through inlet 11 and to exit through outlet 15 for delivery to the temperature controlled space. If the condition sensor 53 senses a relatively high temperature in the space, the nozzle 52 will be substantially closed, providing a relatively high condition signal in the form of a high branch air pressure to actuator 23 and operator 60. The high pressure in chamber 81 will move actuating lever 84 upward to close damper 22 and so prevent entrance of secondary air 14, which we will assume to be return air at the sensed temperature, into the box. As a result maximum cooling is provided, thereby cooling the temperature controlled space rapidly without regard for the comfort of persons in the path of the delivered cool air. The high pressure in chamber 61 will move lever 65 so that the adjustable contact 67 engages the bias beam 68 causing it to move the free end 47 of flapper 45 away from nozzle 77, thus lowering the branch pressure in chamber 71 so that actuating lever 74 is moved downwardly by spring 75, thereby opening wide the damper 20 and permitting a high flow of cool primary air 12 through box 10 for delivery to the temperature controlled space.

The flow of primary air 12 through the restriction 33 will produce a lower pressure on the downstream side thereof. The higher pressure upstream from the restriction at tap 31 is communicated through tube 34 to high pressure chamber 41 in flow transducer 40, while the lower pressure downstream at tap 32 is communicated through tube 35 to the low pressure chamber 42. If the volume rate of flow of primary air through the restriction 33 increases, as due to an increase in pressure at the primary source or a decrease in primary air required to condition other spaces supplied from the same source, the difference between the upstream and downstream pressures will increase, causing the diaphragm 43 to exert a greater downward force through rod 44 against flapper 45 in opposition to the bias force provided by beam 68. As a result, free end 47 will approach nozzle 77, restricting the bleed therethrough, thus increasing the branch air pressure in the pressure chamber 71 and causing actuating lever 74 to move upwardly to partially close the damper 20 and so reduce the volume rate of flow of primary air through the box. If the flow of primary air is reduced, the difference between the upstream and downsteam pressures will be reduced and the damper 20 will be opened further. As a consequence of the opening and closing action of the damper in response to the flow responsive pressure differences received by the flow transducer 40, the volume rate of flow of primary air 12 into the box is maintained substantially constant.

As the sensed temperature in the controlled space falls, the flapper 53 will move away from nozzle 52, allowing more air to bleed therethrough and so lowering the branch air pressure delivered as the condition signal by condition transducer 50 to pressure chambers 61, 81. The lower pressure in chamber 61 will permit spring 64 to rock lever 65 to move the adjustable contact 67 downward and so reduce the bias force applied by bias beam 68 on flapper 45. The flapper 45 will then move downwardly causing its free end 47 to approach nozzle 77, restricting further the bleed of air therethrough and so increasing the branch air pressure in chamber 71. The increased pressure will exert an increased upward force on actuating lever 74, causing a partial closing of damper 20 and a reduction in the volume rate of flow of primary air into the box. This reduction is not as a result of an increase in the sensed volume rate of flow, but of a resetting of the value at which the volume rate of flow is to be maintained in response to a reduced demand for cooling. The lower pressure in chamber 81 will permit spring 85 to move actuating lever 84 downward, resulting in partial opening of the damper 22 to permit entry of secondary air 14, which we assume to be return air at the sensed temperature of the condition controlled space. The flow of primary air 12 through the flow inducing means 17 in box 10 aspirates secondary air 14 into the stream of air resulting in mixed air 16 exiting from outlet 15 for delivery to the condition controlled space. The position of the damper 22 is controlled as a function of the magnitude of the sensed condition in the condition controlled space in a manner to maintain the volume rate of flow of mixed air substantially constant. In other words, as the volume rate of flow of primary air is decreased in response to a decrease in the condition signal, the volume rate of flow of secondary air is increased by a substantially equal amount. A change in the condition signal therefore has an opposite affect upon the volume rates of flow of primary and secondary air. As the magnitude of the sensed condition increases toward a desired set point, the proportion of secondary air is increased with respect to primary air until, at the set point condition, the amount of cooling provided by the primary air delivered into the space just equals the losses therefrom. Further changes in the magnitude of the sensed condition result in modulation of the proportions of primary and secondary air delivered as mixed air into the conditioned space as required to maintain the magnitude of the sensed condition substantially constant at the set point. Although the temperature of the mixed air changes with the proportions of primary and secondary air mixed therein, the volume rate of flow of mixed air remains substantially constant so that the air distribution pattern in the space is unchanged.

It will be obvious to those skilled in the art that many substitutions and modifications can be made within the scope of this invention. The operations of various components can be reversed. Electrical, electronic and mechanical equivalents can be substituted for the pneumatic and mechanical components described. The scope of the invention is defined by the claims.

We claim:

1. Apparatus for controlling the volume rates of flow of conditioned primary air above atmospheric pressure and of secondary air entering an induction air mixing box having a first inlet for receiving the primary air, a second inlet for receiving the secondary air, means for inducing flow of said secondary air into the box in response to a flow of said primary air through the box, an outlet for said primary and secondary air exiting from the box for delivery to a condition controlled space, a first damper for solely controlling the volume rate of flow of said primary air into the box, and a second damper for restricting the volume rate of flow of said secondary air into the box, said apparatus comprising a first actuator for variably positioning said first damper, means responsive to the magnitude of a sensed volume rate of flow of said primary air for controlling operation of said first actuator such that the first damper is variably positioned to maintain a predetermined substantially constant volume rate of flow of said primary air, and a second actuator independent of said first actuator for variably positioning the second damper solely as a function of a sensed magnitude of a controlled condition in said condition controlled space.

2. Apparatus according to claim 1 additionally comprising means responsive to the sensed magnitude of the controlled condition in said condition controlled space for resetting the predetermined substantially constant volume rate of flow of said primary air.

3. Apparatus according to claim 2 further comprising second means responsive to the sensed controlled condition in said condition controlled space for controlling operation of the second actuator such that the sum of the volume rates of flow of said primary and secondary air is maintained substantially constant.

4. Apparatus according to claim 1 wherein said means for controlling operation of said first actuator comprises a flow sensor and a flow transducer, said flow sensor providing an output as a function of the volume rate of flow of said primary air, said flow transducer in communication with the flow sensor converting said output into a flow signal employed to control operation of said first actuator.

5. Apparatus according to claim 4 wherein said flow sensor comprises a flow restriction in the path of said primary air entering the box, and pressure taps upstream and downstream respectively from said restriction; and said flow transducer comprises a high pressure chamber in communication with said upstream pressure tap, a low pressure chamber in communication with the downstream pressure tap, a movable common wall between said high and low pressure chambers, and means for transmitting motion of said common wall to the outside of said flow transducer.

6. Apparatus according to claim 5 wherein said first actuator comprises a first pressure chamber having a first wall movable in response to pressure changes in said first pressure chamber, means comprising a first restriction for receiving main air from a regulated pressure main air supply into said first pressure chamber, a nozzle bleeding air from said first pressure chamber, and means responsive to the flow signal for controlling the rate of bleeding of air through said nozzle.

7. Apparatus according to claim 6 wherein said first actuator further comprises a first bias means exerting a force in opposition to an outward force exerted on said first movable wall by the pressure of air in said first pressure chamber, and means responsive to the resultant of said forces for positioning the first damper.

8. Apparatus according to claim 6 wherein said means for controlling the rate of bleeding of air through said nozzle comprises a flapper, and a biasing means exerting a force to move said flapper in one direction, said flow signal exerting a force to move said flapper in the opposite direction.

9. Apparatus according to claim 8 further comprising means for providing a predetermined minimum force exerted by said biasing means.

10. Apparatus according to claim 8 further comprising means for variably adjusting the force exerted by said biasing means as a function of the sensed controlled condition in the condition controlled space.

* * * * *